US006463834B2

(12) United States Patent
Kemp et al.

(10) Patent No.: US 6,463,834 B2
(45) Date of Patent: Oct. 15, 2002

(54) TORQUE WRENCH

(75) Inventors: Jesse Kemp, Wichita Falls; Jerry Kemp, Round Rock; Glenn Prewett, Arlington, all of TX (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/971,113

(22) Filed: Oct. 5, 2001

(65) Prior Publication Data

US 2002/0040628 A1 Apr. 11, 2002

Related U.S. Application Data

(60) Provisional application No. 60/237,714, filed on Oct. 5, 2000.

(51) Int. Cl.[7] ..... B25B 23/159

(52) U.S. Cl. ..... 81/483; 81/481; 81/467

(58) Field of Search ..... 81/467, 483, 478, 81/480, 481

(56) References Cited

U.S. PATENT DOCUMENTS

| | | | |
|---|---|---|---|
| 2,704,472 | A | 3/1955 | Booth |
| 2,887,919 | A | 5/1959 | Aijala |
| 3,016,773 | A | 1/1962 | Woods |
| 3,276,296 | A | 10/1966 | Woods |
| 3,577,815 | A | 5/1971 | Bergquist |
| 3,581,606 | A | 6/1971 | Grabovac |
| 3,599,515 | A | 8/1971 | Grabovac |
| 3,633,445 | A | 1/1972 | Aijala |
| 3,772,942 | A | 11/1973 | Grabovac |
| 4,126,062 | A | 11/1978 | Solomon |
| 4,207,783 | A | 6/1980 | Grabovac |
| 4,248,107 | A | 2/1981 | Blattner |
| 4,316,397 | A | 2/1982 | Skidmore et al. |
| 4,403,531 | A | 9/1983 | Bailey et al. |
| 4,467,678 | A | 8/1984 | Lindholm |
| 4,485,703 | A | 12/1984 | Grabovac et al. |
| 4,532,836 | A | 8/1985 | Grabovac |
| 4,655,104 | A | 4/1987 | Blattner |
| 4,709,602 | A | 12/1987 | Grabovac et al. |
| 4,732,062 | A | 3/1988 | Grabovac et al. |
| 4,870,879 | A | 10/1989 | Shieh |
| 5,056,384 | A | 10/1991 | Sergan |
| 5,123,289 | A | 6/1992 | Potesta |
| 5,129,293 | A | 7/1992 | Larson et al. |
| 5,152,200 | A | 10/1992 | Kaplan |
| 5,172,616 | A | 12/1992 | Negishi |
| 5,337,638 | A | 8/1994 | Coss et al. |
| 5,435,190 | A | 7/1995 | Jansson et al. |
| 5,497,682 | A | 3/1996 | Hsu |
| 5,503,042 | A | 4/1996 | Larson et al. |
| 5,537,877 | A | 7/1996 | Hsu |
| 5,546,816 | A | 8/1996 | Jansson et al. |
| 5,662,012 | A | 9/1997 | Grabovac |
| 5,859,371 | A | 1/1999 | Hsieh |
| 5,890,406 | A | 4/1999 | Thorn |
| 5,911,801 | A | 6/1999 | Fravalo et al. |

*Primary Examiner*—D. S. Meislin
(74) *Attorney, Agent, or Firm*—Pillsbury Winthrop LLP

(57) ABSTRACT

A tang engaging and stability structure has a tang engaging portion and a pair of stabilizing ear members spaced apart from one another in the direction of the pivot axis. The ear members are positioned on opposing sides of a rear end portion of the tang structure to restrict movement of the tang structure rear end portion generally in the axial direction of the pivot axis. During a torque applying operation, a force applied to the wrench body is transmitted as torque to a fastener removably engaged with the head and tends to pivot the casing structure relative to the drive structure about the pivot axis. When a torsional resistance offered by the fastener reaches a threshold level determined by the biasing force, the force being applied to the wrench body pivots the casing structure relative to the drive structure to the torque exceeded position to generate the torque exceeded signal.

13 Claims, 6 Drawing Sheets

TORQUE WRENCH

The present application claims priority to U.S. Provisional Application of Kemp et al., Serial No. 60/237,714, filed Oct. 5, 2000 the entirety of which is hereby incorporated into the present application by reference.

FIELD OF THE INVENTION

The present invention relates to a torque wrench for applying torque to fasteners.

BACKGROUND OF THE INVENTION

Torque wrenches are well known in the art. Typically, a torque wrench includes a fastener drive structure having a fastener engaging head, such as a ratchet-type head, and an elongated tang member extending from the head. The fastener drive structure is inserted within a casing structure. The fastener drive structure and the casing structure are pivotally connected by a pivot pin for relative pivotal movement between a normal position and a torque exceeded position. A tang engaging member is biased by a spring into engagement with a rear end portion of the tang member to maintain the fastener drive structure and the casing structure in the normal position during a torque applying operation. An adjuster is provided to adjust the stress in the spring. During the application of torque to the fastener, the spring maintains the fastener drive structure and the casing structure in the normal position until the torsional resistance offered by the fastener reaches a threshold level determined by the spring force. Upon reaching that torsional resistance, the manual force being applied to the casing structure pivots the casing structure relative to the fastener drive structure, thereby causing the casing structure to contact the fastener drive structure to create an audible "click." This "click" indicates to the user that the threshold level of torque has been reached.

One shortcoming of these types of torque wrenches is that wear at the pivotal connection between the fastener drive structure and the casing structure allows the fastener drive structure to "wobble" relative to one another about the pivot pin. By this wobbling movement, the rear end portion of the tang member can become displaced relative to the tang engaging member in the direction perpendicular to its normal direction of movement. This can lead to inconsistencies in operation of the wrench.

Consequently, there exists a need for a torque wrench wherein the stability of the fastener drive structure is improved.

SUMMARY OF THE INVENTION

To meet the above-described need, the present invention provides a torque wrench for applying torque to fasteners constructed in accordance with the principles of the present invention. The torque wrench comprises a fastener drive structure having a head which is constructed and arranged to be removably engaged with a fastener and a tang structure extending rearwardly from the head. A wrench body includes a casing structure. The fastener drive structure and the casing structure are pivotally connected for pivotal movement relative to one another from a normal position to a torque exceeded position to generate a torque exceeded signal.

A tang engaging and stabilizing structure has a tang engaging portion and a pair of stabilizing ear members spaced apart from one another in the direction of the pivot axis. The stabilizing ear members are positioned on opposing sides of a rear end portion of the tang structure to restrict movement of the tang structure rear end portion generally in the direction of the pivot axis. The tang engaging portion is engaged with a rear end portion of the tang structure when the fastener drive structure is in the normal position thereof. A stressed biasing element applies a biasing force to the tang engaging and stabilizing structure to maintain the tang engaging portion in engagement with the rear end portion of the tang structure. During a torque applying operation, a force applied to the wrench body is transmitted as torque to a fastener removably engaged with the head and tends to pivot the casing structure relative to the fastener drive structure about the pivot axis. The biasing force applied by the biasing element maintains the tang engaging portion in engagement with the tang structure rear end portion so as to maintain the casing structure and the fastener drive structure in the normal position. When a torsical resistance offered by the fastener reaches a threshold level determined by the biasing force of the biasing element, the force being applied to the wrench body then pivots the casing structure relative to the fastener drive structure to the torque exceeded position to generate the torque exceeded signal. Thus, the signal indicates that the torsional resistance being offered by the fastener has reached the threshold level. An adjuster is constructed and arranged such that movement thereof adjusts the stress in the biasing element and hence the biasing force applied to the tang engaging portion so as to set the aforesaid threshold level of torsional resistance at which the force being applied to the wrench body pivots the casing structure relative to the fastener drive structure as aforesaid.

Other objects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF THE INVENTION

Figure 1:
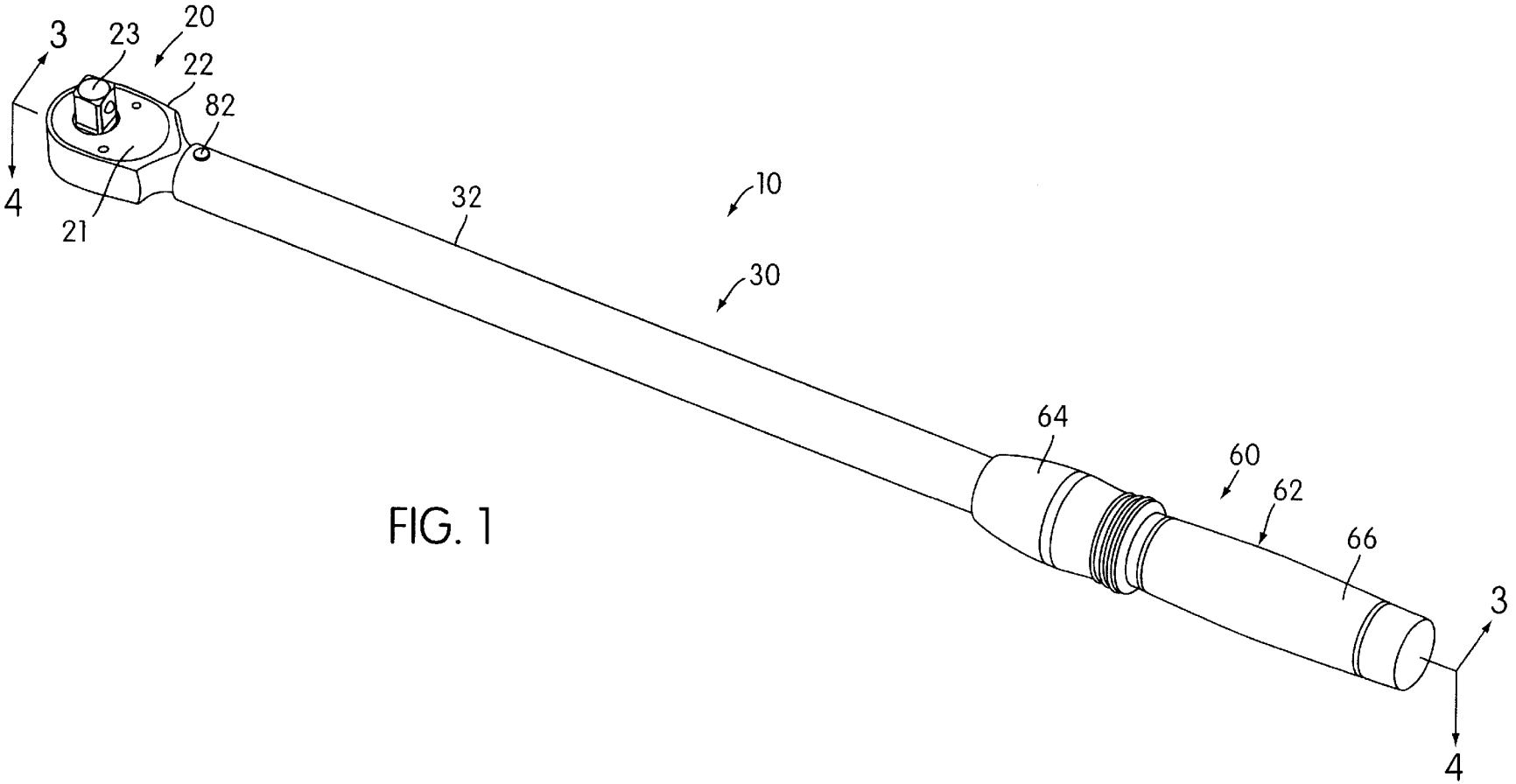
FIG. 1 is a perspective view of a ratchet wrench constructed in accordance with the principles of the present invention.

FIG. 1 shows a torque wrench, generally shown at 10, for selectively applying torque to fasteners, which wrench 10 embodies the principles of the present invention. FIGS. 2–6 show the main components of the wrench, which include a fastener drive structure, generally shown at 20, a wrench body, generally shown at 30, a tang engaging and stabilizing structure, generally shown at 40, a stressed biasing element, generally shown at 50, and an adjuster, generally shown at 60.

Figure 2:
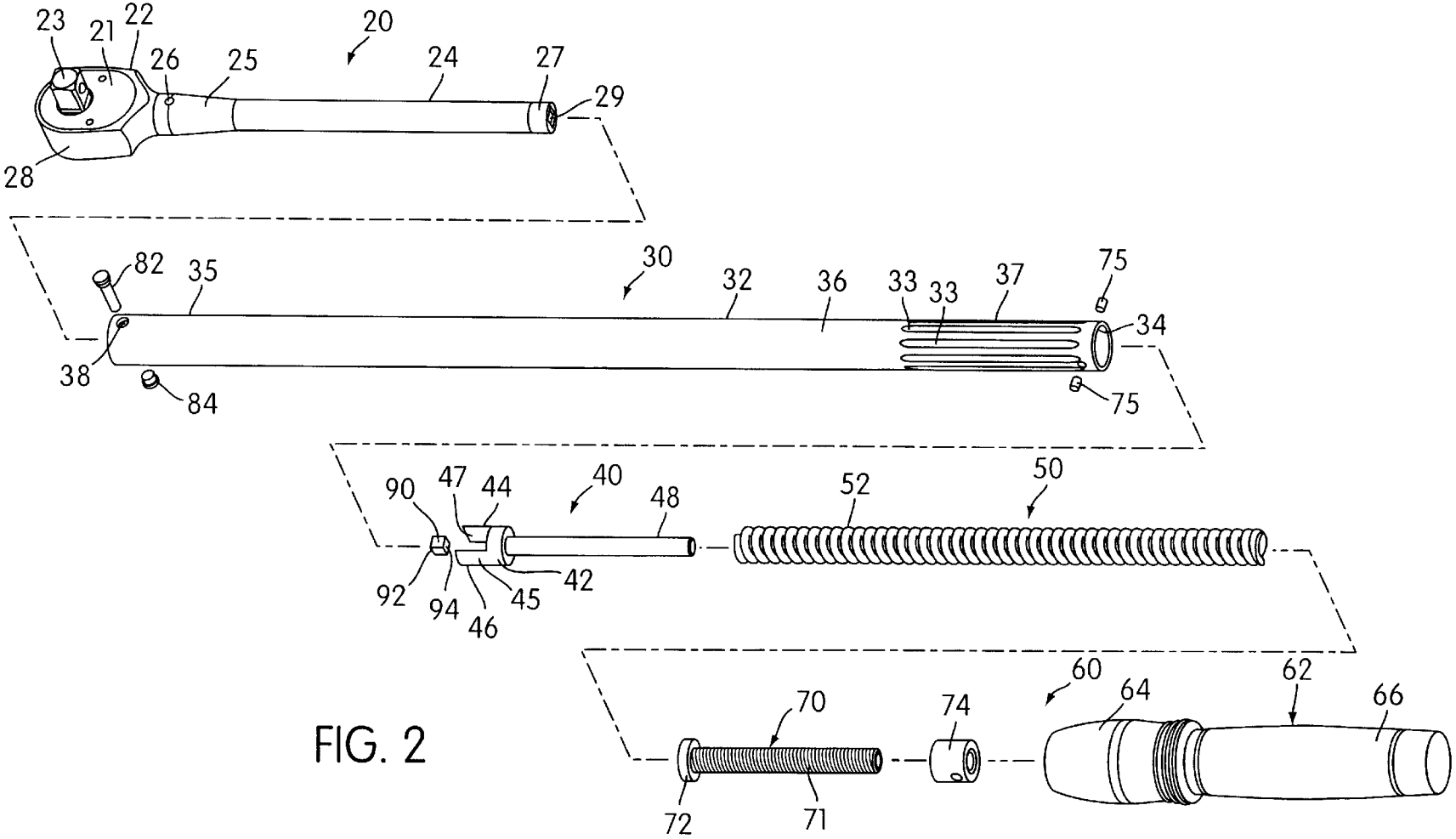
FIG. 2 is an exploded view of the ratchet wrench of FIG. 1.

The fastener drive structure 20 has a head 22 constructed and arranged to be removably engaged with a fastener and a tang structure 24 extending rearwardly from the head 22. The tang structure 24 has a hole 26 extending through a front portion 25 thereof. In the embodiment shown, the head 22 is a conventional socket-type ratchet head. The head 22 comprises a mounting portion 28 integrally formed with the tang structure 24 and a conventional ratchet drive assembly (not shown), which is received within the mounting portion 28. The main components of a conventional ratchet drive assembly are a ratchet gear, a pawl, and a pawl biasing element. The gear is rotatably mounted within the mounting portion such that the gear and the mounting portion are rotatable relative to one another about a gear axis. The gear has a plurality of gear teeth on its outer periphery and a square socket mounting portion, indicated at 23 in FIGS. 1, 2, and 4, for removably mounting a conventional socket to enable removable coupling with a fastener. The pawl is mounted within the mounting portion 28 and is biased into engagement with the gear teeth such that the pawl is in driving engagement with the gear teeth in one direction and ratchets over the gear teeth in an opposite direction. A cover plate, indicated at 21 in FIGS. 1 and 2, is mounted in covering relation over the mounting portion 28 to enclose the gear, the pawl, and the biasing element. The ratchet drive assembly is well known in the art and need not be detailed herein.

The ratchet gear may alternatively be ring-shaped with a fastener receiving opening defined by a plurality of fastener engaging surfaces that are engageable with flat driven surfaces on the head of a fastener received therein. Additionally, although the head 22 is preferably the ratcheting-type, the present invention may be practiced with a non-ratcheting head, such as an open-ended wrench head.

The wrench body 30 includes a generally cylindrical casing structure 32 with generally cylindrical interior and exterior surfaces 34, 36. One end portion 35 of the casing structure 32 has a hole 38 therethrough. The opposite end portion 37 is constructed to mount the adjuster 60, described in greater detail below. Although the principles of the invention are preferred for application to a wrench with a cylindrical casing structure (i.e. a round case wrench), they may be practiced in a wrench with a casing structure of rectangular cross-section (i.e. a flat case wrench).

Figure 3:
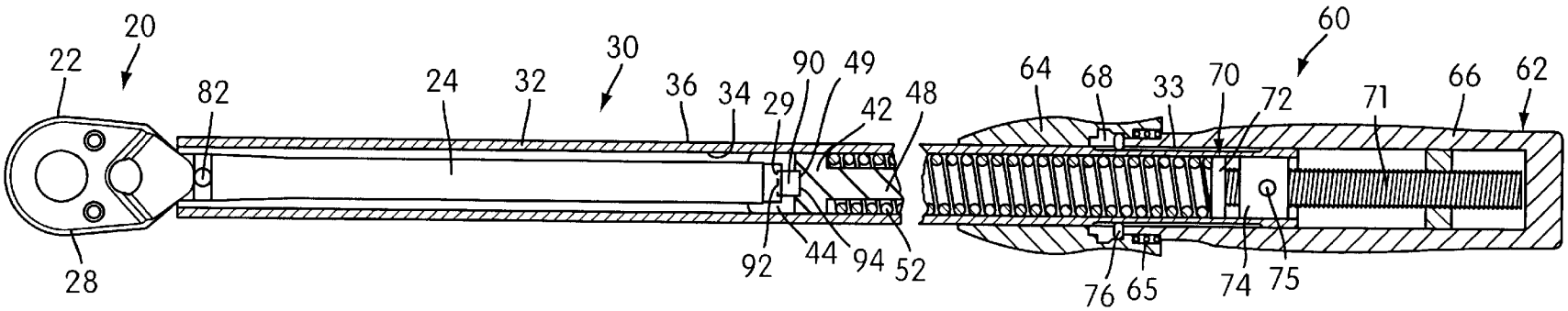
FIG. 3 is a cross-sectional view taken along line 3—3 of FIG. 1 showing the components of the ratchet wrench in a normal position.
Figure 4:
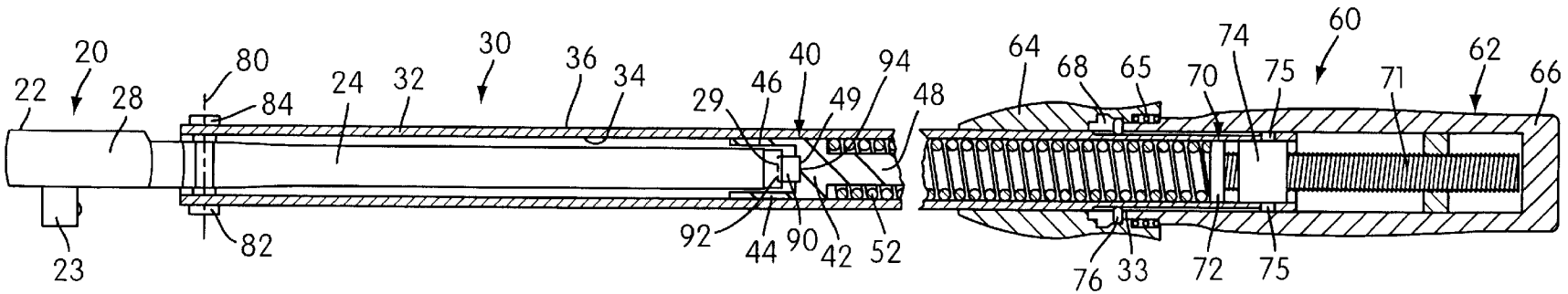
FIG. 4 is a cross-sectional view taken along line 4—4 of FIG. 1 showing the components of the ratchet wrench in a normal position.
Figure 6:
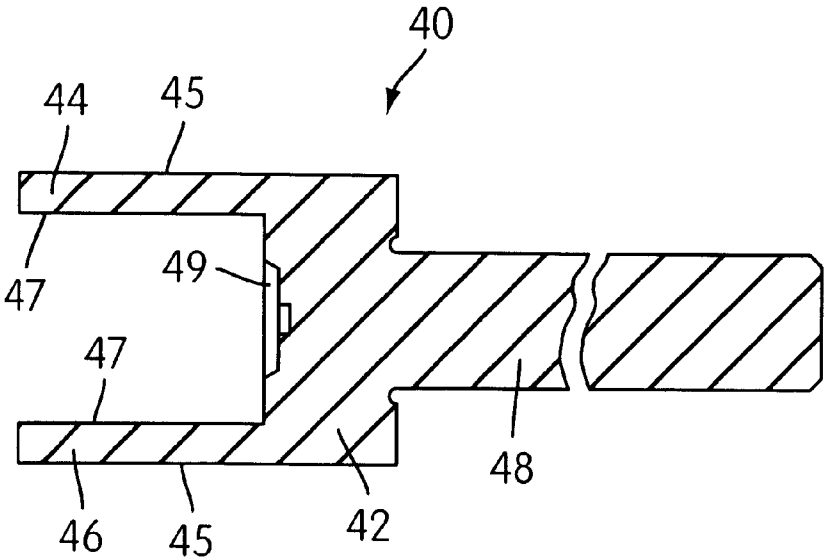
FIG. 6 is a cross-sectional view taken along line 6—6 in FIG. 5.
Figure 5:
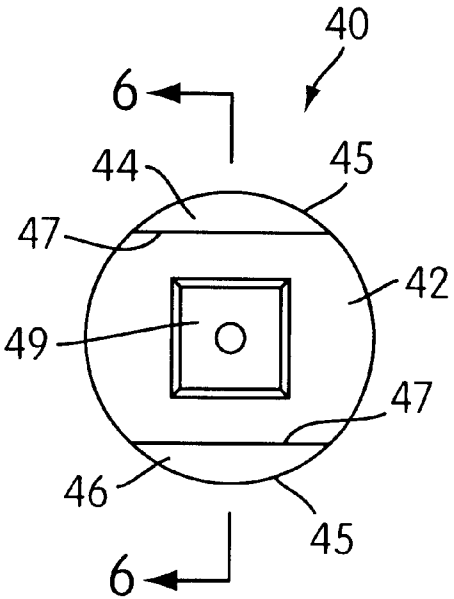
FIG. 5 is a front view of a tang engaging member constructed in accordance with the principles of the present invention.
Figure 7:
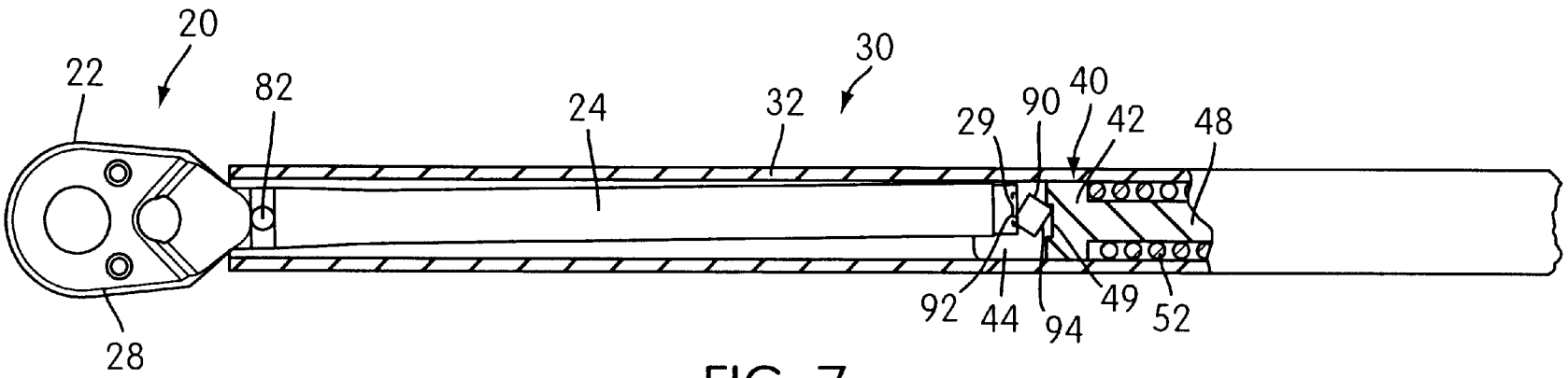
FIG. 7 is an enlarged sectional view showing the components of the ratchet wrench at a torque exceeded position.

The fastener drive structure 20 and the casing structure 32 are pivotally connected for pivotal movement relative to one another about a pivot axis 80 between a normal position, as shown in FIGS. 3–4, and a torque exceeded position, as shown in FIG. 7, wherein a torque exceeded signal is generated, as will be further discussed below. Specifically, the tang structure 24 of the fastener drive structure 20 is inserted within the casing structure 32 and the holes 26, 38 are aligned. Then, a pivot pin 82 is inserted through the holes 26, 38. The pin 82 is secured by a pivot pin end 84. As a result, the fastener drive structure 20 and the casing structure 32 pivot about the pivot pin 82, which defines the pivot axis 80.

The tang engaging and stabilizing structure 40, also referred to as a plunger, has a tang engaging portion 42 and a pair of stabilizing ear members 44, 46 spaced apart from one another in the direction of the pivot axis 80. A shaft 48 extends rearwardly from the tang engaging portion 42. The stabilizing ear members 44, 46 are positioned on opposing sides of a rear end portion 27 of the tang structure 24 to restrict movement of the tang structure rear end portion 27 generally in the direction of the pivot axis 80, but allow relative pivotal movement between the casing structure 32 and the fastener drive structure 20 about the pivot axis 80. The stabilizing ear members 44, 46 have rounded outer surfaces 45 conforming to the interior surface 34 of the casing structure 32. Inner surfaces 47 of the ear members 44, 46 are parallel to each other and perpendicular to the pivot axis 80.

The ear members 44, 46 of the tang engaging and stabilizing structure 40 stabilize the tang structure 24 by restricting movement of its tang structure rear end portion 27 in the direction of the pivot axis 80. As a result, relative movement between the fastener drive structure 20 and the casing structure 32 is substantially restricted to pivotal movement about the pivot axis 80. The ear members 44, 46 also add stability to the tang engaging and stabilizing member 40 by increasing its effective overall length to approximately 1.5 times the width of the inside diameter of the casing structure 32. In the illustrated embodiment, the tang engaging and stabilizing member 40 is comprised of a single component, thus facilitating assembly. Alternatively, the tang engaging and stabilizing member 40 may have a multiple piece construction, but a one-piece component is preferred.

The rear end portion 27 of the tang structure 24 and the tang engaging portion 42 each hate a recess 29, 49 formed therein. A tilt block 90, which may be considered to be part of the tang structure rear end portion 27, is received in the recesses 29, 49 and is movable between the recesses 29, 49 to accommodate pivotal movement of the casing structure 32 and the tang engaging and stabilizing structure 40 relative to the fastener drive structure 20.

The tilt block 90 is a cube. Thus, forward and rearward ends 92, 94 of the tilt block 90 each have a pair of generally parallel edges. The recesses 29, 49 of the tang rear end portion 27 and the tang engaging portion 42 also each have a pair of generally parallel edges. The tilt block 90 and the recesses 29, 49 are oriented such that the pairs of generally parallel edges are arranged generally parallel to one another. Further, the tilt block 90 is configured such that a distance between opposite edges of the forward and rearward ends 92, 94 thereof is greater than a distance between adjacent edges of the forward and rearward ends 92, 94 thereof.

The stressed biasing element 50, in the form of a coil spring 52, applies a biasing force to the tang engaging and stabilizing member 40 to maintain the recess 49 of the tang engaging portion 42 in engagement with the tilt block 90 so as to maintain the casing structure 32 and the fastener drive structure 20 in the normal position thereof, as shown in FIGS. 3–4. The biasing element 50 extends around the shaft 48. One end 54 of the biasing element 50 engages against the tang engaging portion 42 and an opposite end 65 engages against a head portion 72 of a load screw 70.

The load screw 70 is a component of the adjuster 60 and axial movement thereof adjusts the stress in the biasing element 50 and hence the biasing force applied to the tang engaging portion 42 by the biasing element 50.

Figure 8:
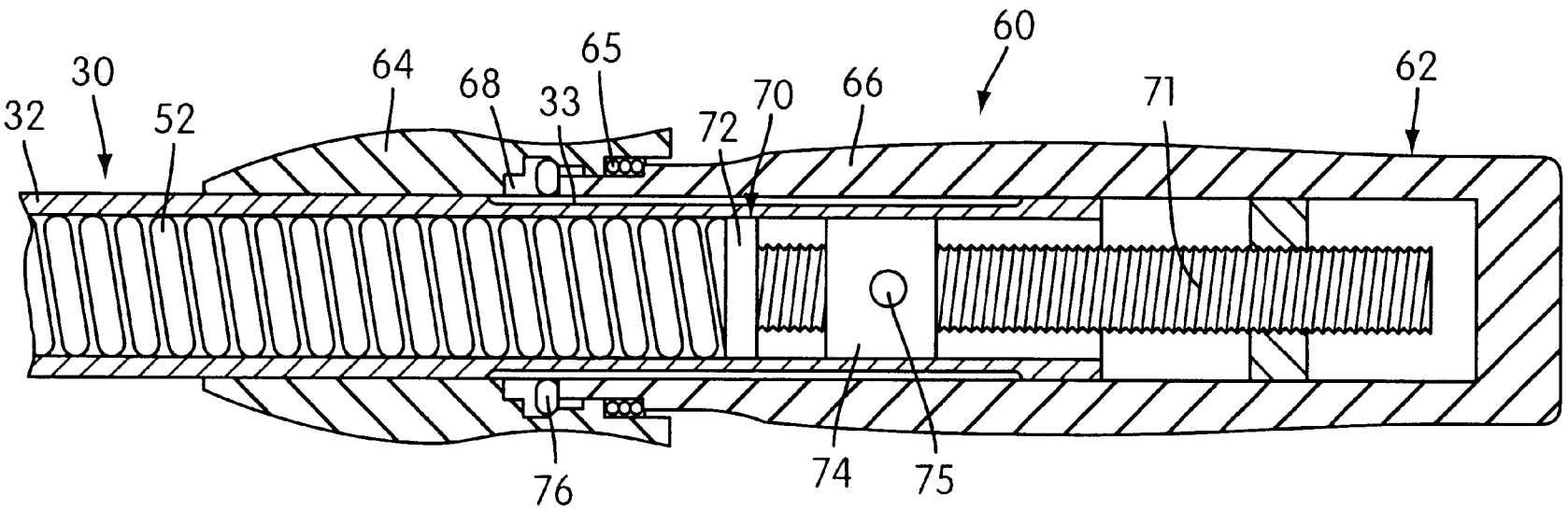
FIG. 8 is an enlarged sectional view showing an adjusting position of the adjuster.

Specifically, the load screw 70 has a threaded shaft portion 71. A load nut 74 is secured to the end portion 37 of the casing structure 32 by retaining pins 75, which pins 75 extend through holes in the casing structure 32 and the load nut 74. The shaft portion 71 extends through the load nut 74 and is fixed within a grip portion, generally shown at 62, of the adjuster 60. The grip portion 62 comprises a front portion 64 and a rear portion 66, which are coupled such that axial movement with respect to one another is permitted. The front portion 64 is biased forwardly from the rear portion 64 by a spring 65. The front portion 64 has a plurality of recesses 68, wherein each recess 68 includes a locking portion and an adjusting portion. The recesses 68 of the front portion 64 are positioned over a corresponding series of longitudinally extending grooves 33 of the casing structure 32. A ball 76 is received between the locking portion of each recess 68 and a corresponding groove 33 to prevent rotational movement of the grip portion 62 with respect to the casing structure 32. Referring to FIG. 8, to adjust the biasing force, the front portion 64 is moved rearwardly relative to the rear portion 66 against the biasing of the spring 65 such that the balls 76 are positioned in the adjusting portions of the recesses 68. Rotational movement of the gripping portion 62 rotates the gripping portion 62 relative to the casing structure 32, with the balls 76 moving along adjacent grooves 33. This rotational movement of the gripping portion 62 adjusts the load screw 70 axially with respect to the load nut 74 to adjust the biasing force applied to the tang engaging and stabilizing structure 40 by the biasing element 50.

The operation of the torque wrench 10 will now be described in greater detail. First, the operator grasps the wrench 10 about the grip portion 62 of the adjuster 60 and removably engages the head 22 with the fastener. The user then applies force to the wrench body 30, which is transmitted as torque to the removably engaged fastener via the tang engaging and stabilizing structure 40 and the fastener drive structure 20. However, this force also tends to pivot the casing structure 32 relative to the fastener drive structure 20 about the pivot axis 80.

In the type of wrench where a ratchet drive assembly is used, when the socket of the head 22 is coupled to a fastener in torque transmitting relation, the manual force applied in the torque applying direction to the wrench body 30 is transmitted from the wrench body 30 to the fastener drive structure 20 and then from the fastener drive structure to the fastener via the driving engagement between the pawl and the ratchet gear so as to apply torque to the fastener to affect rotation thereof. A manual force applied to the wrench body 30 in a ratcheting direction, opposite the torque applying direction, causes rotation of the wrench body 30 relative to the ratchet gear with the pawl repeatedly ratcheting over the gear teeth against the biasing of the pawl biasing element.

The biasing force applied by the biasing element 50 maintains the tang engaging portion 42 in engagement with the tang rear end portion 27, particularly the tilt block 90, so as to maintain the casing structure 32 and the fastener drive structure 20 in the normal position thereof until a torsional resistance offered by the fastener reaches a threshold level determined by the biasing force of the biasing element 50. Specifically, in the illustrated embodiment, the engagement of the tang engaging portion 42 maintains the tang structure 24 (and the entire fastener drive structure 20) in substantial alignment with the casing structure 32. At the threshold level of fastener resistance, the force being applied to the wrench body 30 overcomes the biasing force of the biasing element 50 and pivots the casing structure 32 relative to the fastener drive structure 20 to the torque exceeded position, as shown in FIG. 7, to generate the torque exceeded signal. The signal indicates that the torsional resistance being offered by the fastener has reached the threshold level.

The torque exceeded signal in the illustrated embodiment is generated by the rear end portion 27 of the tang structure 24 and the casing structure 32 contacting one another in the torque exceeded position to generate an audible noise, as shown in FIG. 7. It is contemplated that a contact switch may be positioned at the contact point of the tang structure 24 and the casing structure 32 which actuates a signal light or audible beeping noise to the user that the threshold level has been reached.

The tilt block 90 and the recesses 29, 49 are configured such that, during the pivotal movement of the casing structure 32 relative to the fastener drive structure 20 to the torque exceeded position, the tilt block 90 pivots with one edge of the forward end 92 thereof pivoting about one edge of the recess 29 of the tang rear end portion 27 and an opposite one of the edges of the rearward end 94 thereof pivoting about the recess 49 of the tang engaging portion 42. The biasing element 50 is increasingly stressed during the aforesaid pivotal movement thereof by the tilt block 90 urging the tang engaging and stabilizing structure 40 rearwardly as a result of the distance between the opposite edges thereof being greater than the adjacent edges thereof.

The ear members 44, 46 of the tang engaging and stabilizing structure 40 stabilize the tang structure 24 by restricting movement of its tang structure rear end portion 27 in the direction of the pivot axis 80. As a result, relative movement between the fastener drive structure 20 and the casing structure 32 is substantially restricted to pivotal movement about the pivot axis 80.

Moreover, the tang engaging and stabilizing structure 40 contributes to the effective operation of the tilt block 90. Specifically, the tang engaging and stabilizing structure 40 only permits pivotal movement of the tilt block 90 about edges of the forward and rearward ends 92, 94 that are parallel to the pivot axis 80. Because the ear members 44, 46 of the tang engaging and stabilizing structure 40 restrict movement of the tang structure rear end portion 27 in the direction of the pivot axis 80, pivotal movement of the tilt block 90 about edges of the forward and rearward ends 92, 94 that are perpendicular to the pivot axis 80 is prevented. Therefore, the threshold level can remain accurate over the life of the tool. However, the tang engaging and stabilizing structure 40 may be practiced without a tilt block, although it is particularly advantageous in combination with a tilt block.

The biasing force applied by the biasing element 50 maintains the engagement of the recess 49 of the tang engaging portion 42 with the tilt block 90 so as to maintain the casing structure 32 and the fastener drive structure 20 in the normal position thereof, as shown in FIG. 3–4, until the torsional resistance offered by the fastener reaches the aforesaid threshold level whereat the force being applied to the casing structure 32 is sufficient to affect the aforesaid pivotal movement of the tilt block 90 against the biasing force of the biasing element 50, as shown in FIG. 7.

The adjuster 60 sets the aforesaid threshold level of torsional resistance at which the force being applied to the wrench body 30 pivots the casing structure 32 relative to the fastener drive structure 20. As aforesaid, the gripping portion 62 of the adjuster 60 may be rotated relative to the casing structure 32 to adjust the load screw 70 and hence the biasing force applied to the tang engaging and stabilizing structure 40 by the biasing element 50.

The present invention is not limited to the tilt block 90. Other arrangements are contemplated which can accommodate pivotal movement for purposes of determining a threshold level. Moreover, it is contemplated that the fastener drive structure, as shown in U.S. Pat. No. 4,732,062 to Grabovac et al, the entirety of which is hereby incorporated into the present application by reference could be implemented into the present invention.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. A torque wrench for applying torque to fasteners, said torque wrench comprising:

a fastener drive structure having a head constructed and arranged to be removably engaged with a fastener, and a tang structure extending rearwardly from said head;

a wrench body including a casing structure, said fastener drive structure and said casing structure being pivotally connected for pivotal movement relative to one another about a pivot axis from a normal position to a torque exceeded position to generate a torque exceeded signal;

a tang engaging and stabilizing structure having a tang engaging portion and a pair of stabilizing ear members spaced apart from one another in the axial direction of said pivot axis, said stabilizing ear members being positioned on opposing sides of a rear end portion of said tang structure to restrict movement of the tang structure rear end portion generally in the axial direction of said pivot axis, said tang engaging portion being engaged with a rear end portion of said tang structure when said fastener drive structure is in said normal position thereof;

a stressed biasing element applying a biasing force to said tang engaging and stabilizing structure such that, during a torque applying operation wherein a force applied to said wrench body (a) is transmitted as torque to a fastener removably engaged with said head and (b) tends to pivot said casing structure relative to said fastener drive structure about said pivot axis, the biasing force applied by said biasing element maintains said tang engaging portion in engagement with said tang structure rear end portion so as to maintain said casing structure and said fastener drive structure in said normal position thereof until a torsional resistance offered by the fastener reaches a threshold level determined by the biasing force of said biasing element whereat the force being applied to said wrench body pivots said casing structure relative to said fastener drive structure to said torque exceeded position to generate the torque exceeded signal, thus indicating that the torsional resistance being offered by the fastener has reached the threshold level; and an adjuster constructed and arranged such that movement thereof adjusts the stress in said biasing element and hence the biasing force applied to said tang engaging portion by said biasing element so as to set the aforesaid threshold level of torsional resistance at which the force being applied to said wrench body pivots said casing structure relative to said fastener drive structure as aforesaid.

2. A torque wrench according to claim 1, wherein said casing structure is tubular.

3. A torque wrench according to claim 2, wherein said casing structure is generally cylindrical with generally cylindrical interior and exterior surfaces.

4. A torque wrench according to claim 3, wherein said stabilizing ear members have rounded outer surfaces conforming to the interior surface of said casing structure.

5. A torque wrench according to claim 1, wherein said torque exceeded signal is generated by said tang structure and said casing structure contacting one another in said torque exceeded position to generate an audible noise.

6. A torque wrench according to claim 1, wherein the rear end portion of said tang structure has a recess formed therein and wherein said tang engaging portion has a recess formed therein, said tang structure rear end portion including a tilt block received in said recesses, said tilt block being movable between said recesses to accommodate pivotal movement of said casing structure relative to said head structure.

7. A torque wrench according to claim 6, wherein a forward end of said tilt block has a pair of generally parallel edges, a rearward end of said tilt block has a pair of generally parallel edges, the recess of said tang structure rear end portion has a pair generally parallel edges, and the recess of said tang engaging portion has a pair of generally parallel edges, said tilt block and said recesses being oriented such that said pairs of generally parallel edges are arranged generally parallel to one another, said tilt block being configured such that a distance between opposite edges of said front and rear ends thereof is greater than a distance between adjacent edges of said front and rear ends thereof;

said tilt block and said recesses being configured such that, during the pivotal movement of said casing structure relative to said fastener drive structure to said torque exceeded position, said tilt block pivots with one edge of the front end thereof pivoting about one edge of the recess of said tang rear end portion and an opposite one of the edges of the rear end thereof pivoting about the recess of said tang engaging portion, said biasing element being increasingly stressed during the aforesaid pivotal movement thereof said tilt block urging said tang engaging member rearwardly as a result of the distance between said opposite edges thereof being greater than said adjacent edges thereof;

the biasing force applied by said biasing element maintaining the recess of said tang engaging portion in engagement with said tilt block so as to maintain said casing structure and said fastener drive structure in said normal position thereof until the torsional resistance offered by the fastener reaches the aforesaid threshold level whereat the force being applied to said casing is sufficient to affect the aforesaid pivotal movement of said tilt block against the biasing force of said biasing element.

8. A torque wrench according to claim 1, wherein said tilt block is a cube.

9. A torque wrench according to claim 1, wherein said stressed biasing element is a coil spring.

10. A torque wrench according to claim 1, wherein said head and said tang structure pivot together as a unitary structure.

11. A torque wrench according to claim 1, wherein said adjuster comprises:

a load screw operatively engaged with said biasing element; and a grip portion adjustably secured to said load screw such that rotational movement of said grip portion adjusts said load screw axially which adjusts the stress in said biasing element.

12. A torque wrench according to claim 11, wherein said grip portion includes a front portion and a rear portion coupled for axial movement with respect to one another, said front portion being spring biased forwardly from said rear portion to a locking position of said grip portion and rearwardly moveable relative to said rear portion against the biasing of the spring to an adjusting position of said grip portion.

13. A torque wrench according to claim 12, wherein said adjuster further comprises a plurality of balls, said balls received between a plurality of recesses formed in said front portion and a corresponding series of longitudinally extending grooves of said casing structure, wherein said recesses are configured and positioned such that said balls prevent rotational movement of said grip portion when in said locking position and permit rotational movement of said grip portion when in said adjusting position.

* * * * *